US008269640B2

(12) United States Patent
Ueno et al.

(10) Patent No.: US 8,269,640 B2
(45) Date of Patent: Sep. 18, 2012

(54) ODOR-GENERATING ALARM APPARATUS

(75) Inventors: Yasuhiro Ueno, Kobe (JP); Hirofumi Onishi, Kobe (JP); Hideaki Goto, Kobe (JP); Koichiro Mizoguchi, Kobe (JP); Tomo Sakai, Kobe (JP); Katsuyuki Kitahara, Kobe (JP)

(73) Assignee: Air Water Safety Service Inc., Hyogo (JP)

( * ) Notice: Subject to any disclaimer, the term of this patent is extended or adjusted under 35 U.S.C. 154(b) by 370 days.

(21) Appl. No.: 12/450,281

(22) PCT Filed: Mar. 21, 2008

(86) PCT No.: PCT/JP2008/055302

§ 371 (c)(1),
(2), (4) Date: Sep. 18, 2009

(87) PCT Pub. No.: WO2008/117757

PCT Pub. Date: Oct. 2, 2008

(65) Prior Publication Data

US 2010/0079298 A1 Apr. 1, 2010

(30) Foreign Application Priority Data

Mar. 23, 2007 (JP) ..... P2007-077751
Jun. 7, 2007 (JP) ..... P2007-152056

(51) Int. Cl.
*G08B 17/10* (2006.01)

(52) U.S. Cl. ..... 340/632; 340/627; 340/520; 340/550; 340/552; 340/524; 340/574

(58) Field of Classification Search ..... 340/632, 340/627, 541, 552, 520, 550, 574, 524
See application file for complete search history.

(56) References Cited

U.S. PATENT DOCUMENTS 4,394,934 A * 7/1983 Fegley ..... 222/5
5,034,730 A 7/1991 Lin
5,055,822 A * 10/1991 Campbell et al. ..... 340/407.1
5,257,012 A * 10/1993 Metcalf ..... 340/573.2
2006/0290522 A1 12/2006 Tajima et al.
2008/0111687 A1* 5/2008 Husmann ..... 340/552

FOREIGN PATENT DOCUMENTS

DE 200 09 174 7/2001

(Continued)

OTHER PUBLICATIONS

Extended Search Report for corresponding European patent application No. 08722654.4 dated Jun. 30, 2011.

(Continued)

*Primary Examiner* — Tai T Nguyen
(74) *Attorney, Agent, or Firm* — Harness, Dickey & Pierce, P.L.C.

(57) ABSTRACT

One embodiment of the present invention discloses an odor-generating alarm apparatus that can ensure the reliability of a releasing operation and the odor dispersibility. In an odor-generating alarm apparatus, when abnormality information indicating occurrence of an abnormal state is supplied from a sensor for occurrence of an abnormal state, an initiator is operated by a circuit portion, and the initiator displaces a piston of a driving portion and displaces a spray can with respect to a casing and switches the spray can to a releasing state, thus releasing an odorous liquid filling the spray can in the form of fine particles.

4 Claims, 9 Drawing Sheets

FOREIGN PATENT DOCUMENTS

| | | |
|---|---|---|
| EP | 1 617 390 | 1/2006 |
| FR | 2 620 843 | 3/1989 |
| JP | 4-76348 | 3/1992 |
| JP | 6-76179 | 3/1994 |
| JP | 8-214760 | 8/1996 |
| JP | 2000-189033 | 7/2000 |
| JP | 2004-78345 | 3/2004 |
| JP | 2004-326326 | 11/2004 |
| WO | WO 2004/095387 | 11/2004 |

OTHER PUBLICATIONS

Office Action for corresponding Korean patent application No. 10-2009-7019549 dated Apr. 20, 2011 and English translation thereof.

Office Action for corresponding Chinese patent application No. 200880009421.3 dated Sep. 30, 2010 and English translation thereof.

Office Action dated Mar. 8, 2012 for corresponding European patent application No. 08722654.4.

* cited by examiner

ODOR-GENERATING ALARM APPARATUS

TECHNICAL FIELD

The present invention relates to an odor-generating alarm apparatus that gives notice of a fire or another abnormal state by generating odor.

BACKGROUND ART

Conventional fire alarm apparatuses detect heat, smoke, gas, the light of flames, and the like generated by a fire, and confirm a fire, upon detecting one of these factors alone, or a combination of these factors in order to prevent an erroneous alarm and the like. A signal obtained by such detection is supplied to a fire-extinguishing apparatus, a bell or the like is rung, and a sprinkler or the like is operated. However, it is difficult for hearing-impaired people to notice an alarm from this sort of fire alarm apparatus, and thus, there may be a delay in starting evacuation.

An alarm apparatus for solving the above-described problem that it is impossible to notify such hearing-impaired people of a breaking fire when a fire breaks out, is disclosed. This alarm apparatus gives notice of a fire or another emergency state by dispersing odor when a fire breaks out (see Japanese Unexamined Patent Publication JP-A 2004-326326, for example).

Although the above-described conventional technique discloses apparatuses that generate odor according to various methods, in all such apparatuses, releasing means is configured from a mechanical constituent element. Thus, corrosion and the like make it impossible to reliably perform a releasing operation in an emergency state. Also, it is impossible to efficiently disperse the odor. Accordingly, this configuration is problematic in that the people that are to be notified take time to recognize the odor.

DISCLOSURE OF INVENTION

It is an object of the invention to provide an odor-generating-and-stopping alarm apparatus that can ensure the reliability of a releasing operation and the odor dispersibility.

The invention is directed to an odor-generating alarm apparatus, comprising:

a casing that defines an accommodation space capable of accommodating a spray can that is filled with an odorous liquid and can be switched between a releasing state in which the odorous liquid is released and a non-releasing state;

switching means for performing a switching operation from the non-releasing state to the releasing state by displacing the spray can accommodated in the accommodation space of the casing with respect to the casing; and control means for causing the switching means to perform a switching operation from the non-releasing state to the releasing state by displacing the spray can with respect to the casing, when abnormality information indicating occurrence of an abnormal state is supplied from detecting means for detecting occurrence of an abnormal state.

Furthermore, in the invention, it is preferable that the switching means further comprises an operating portion made of a material that is extended and contracted by application of electricity, and the control means displaces the spray can by applying electricity to the operating portion.

Furthermore, in the invention, it is preferable that the switching means generates gas by igniting an explosive, and uses a pressure of the gas to displace the spray can.

Furthermore, in the invention, it is preferable that the odor-generating alarm apparatus further comprises buffer means for buffering a shock generated when the switching means displaces the spray can in the accommodation space.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
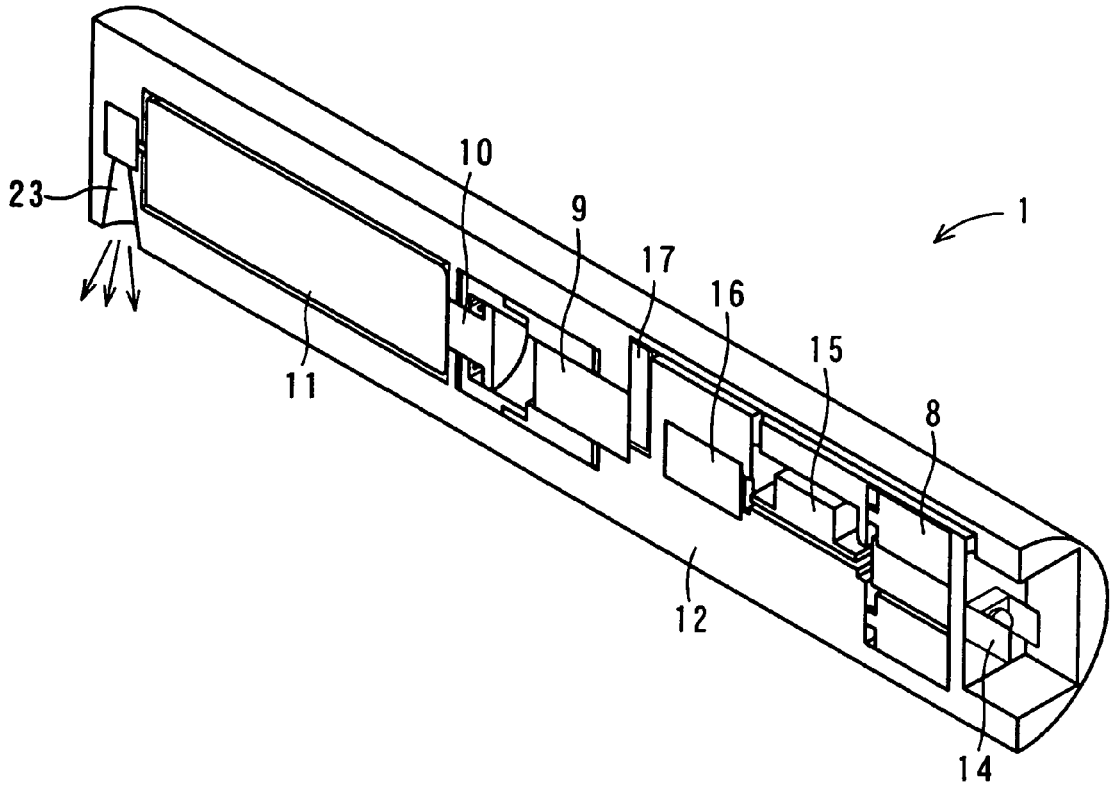
FIG. 1 is a cross-sectional perspective view schematically showing an odor-generating alarm apparatus according to a first embodiment of the invention.

Now referring to the drawings, preferred embodiments of the invention are described on a plurality of embodiments below. In the embodiments, a portion corresponding to that described in a foregoing embodiment may be denoted by the same reference numeral, and the description thereof may not be repeated. In a case where only part of a configuration is described, the other portions of the configuration are similar to those previously described. In addition to a combination of portions specifically described in the embodiments, a partial combination of the embodiments is also possible as long as the combination does not cause any problem.

Figure 2:
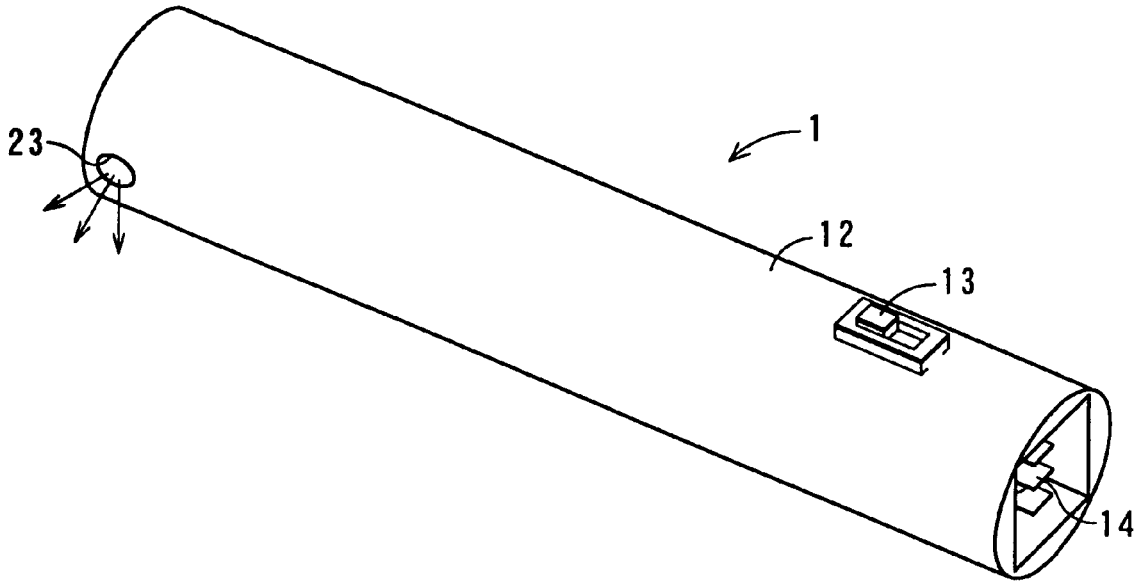
FIG. 2 is a perspective view schematically showing the odor-generating alarm apparatus.
Figure 3:
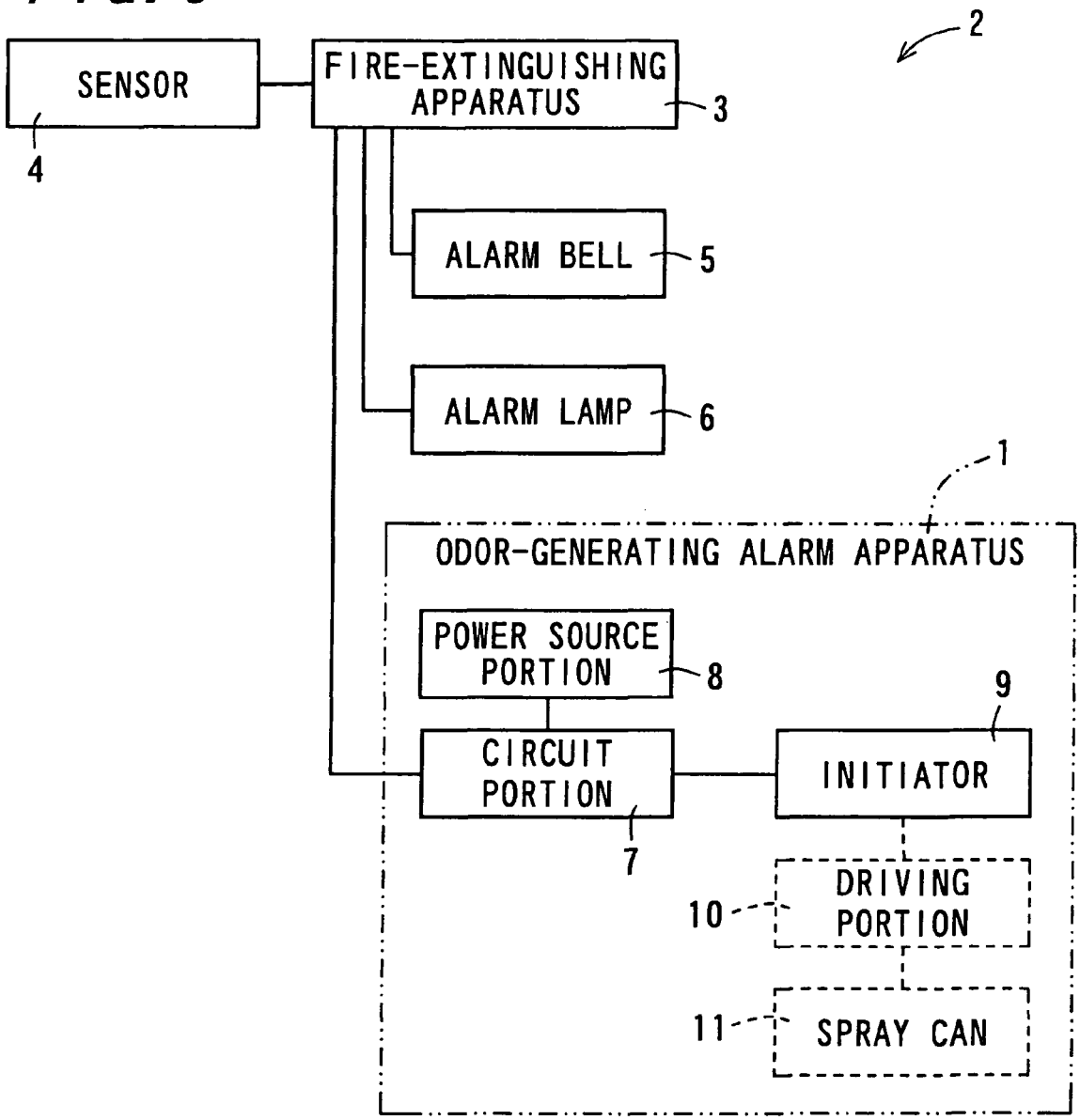
FIG. 3 is a block diagram showing the electrical configuration of an alarm system including the odor-generating alarm apparatus.

FIG. 1 is a cross-sectional perspective view schematically showing an odor-generating alarm apparatus 1 according to a first embodiment of the invention. FIG. 2 is a perspective view schematically showing the odor-generating alarm apparatus 1. FIG. 3 is a block diagram showing the electrical configuration of an alarm system 2 including the odor-generating alarm apparatus 1. The alarm system 2 operates a fire-extinguishing apparatus 3, such as a sprinkler, upon detecting a fire or another abnormal state. In the case of an abnormal state, the fire-extinguishing apparatus 3 gives notice of the abnormal state using the odor-generating alarm apparatus 1 functioning as alarm means. Referring to FIG. 3, the alarm system 2 includes a sensor 4, the fire-extinguishing apparatus 3, the odor-generating alarm apparatus 1, and an alarm bell 5 and an alarm lamp 6 functioning as another alarm means.

The sensor 4 is detecting means, and detects the occurrence of an abnormal state. Upon detecting the occurrence of an abnormal state, the sensor 4 supplies abnormality information indicating the occurrence of an abnormal state to the fire-extinguishing apparatus 3. For example, the sensor 4 detects heat, smoke, gas, the light of flames, and the like generated by a fire, and confirms a fire, upon detecting one of these factors alone, or a combination of these factors in order to prevent an erroneous alarm and the like. The sensor 4 supplies the abnormality information to the fire-extinguishing apparatus 3, upon confirming a fire based on the detected information.

The fire-extinguishing apparatus 3 is electrically connected to the sensor 4, and starts a fire-extinguishing operation when the abnormality information is supplied from the sensor 4. For example, the fire-extinguishing apparatus 3 operates fire-extinguishing means such as a sprinkler, a smoke-eliminating apparatus, and the like. Furthermore, when the abnormality information is supplied from the sensor 4, the fire-extinguishing apparatus 3 controls the alarm means 1, 5 and 6 so as to raise an alarm. Each of the alarm bell 5, the alarm lamp 6, and the odor-generating alarm apparatus 1 is alarm means, is electrically connected to the fire-extinguishing apparatus 3, and raises an alarm when the abnormality information is supplied from the fire-extinguishing apparatus 3. The alarm bell 5 generates an alarm sound, the alarm lamp 6 generates light, and the odor-generating alarm apparatus 1 generates odor.

Next, referring to FIG. 3, the electrical configuration of the odor-generating alarm apparatus 1 will be described in detail. The odor-generating alarm apparatus 1 includes a circuit portion 7, a power source portion 8, an initiator 9, a driving portion 10, and a spray can 11. In FIG. 3, for facilitating understanding, the driving portion 10 and the spray can 11 that are not electrically connected are imaginarily shown. The circuit portion 7 functions as control means, and operates the initiator 9 when the abnormality information is supplied from the sensor 4. The circuit portion 7 is electrically connected to the sensor 4, and supplies a current to the initiator 9 when the abnormality information is supplied from the sensor 4. The initiator 9 is heated by the current, and an igniting agent (an explosive) contained in the initiator 9 is ignited. When the igniting agent is ignited, the heat of the explosive causes a chemical reaction of a gas-generating agent, and gas is generated. Due to the pressure of the gas, the driving portion 10 operates, and the spray can 11 is displaced. Accordingly, an odorous liquid filling the spray can 11 is released. Thus, the initiator 9 and the driving portion 10 function as switching means, and perform a switching operation from a non-releasing state to a releasing state by displacing the spray can 11 with respect to a casing 12.

Figure 4:
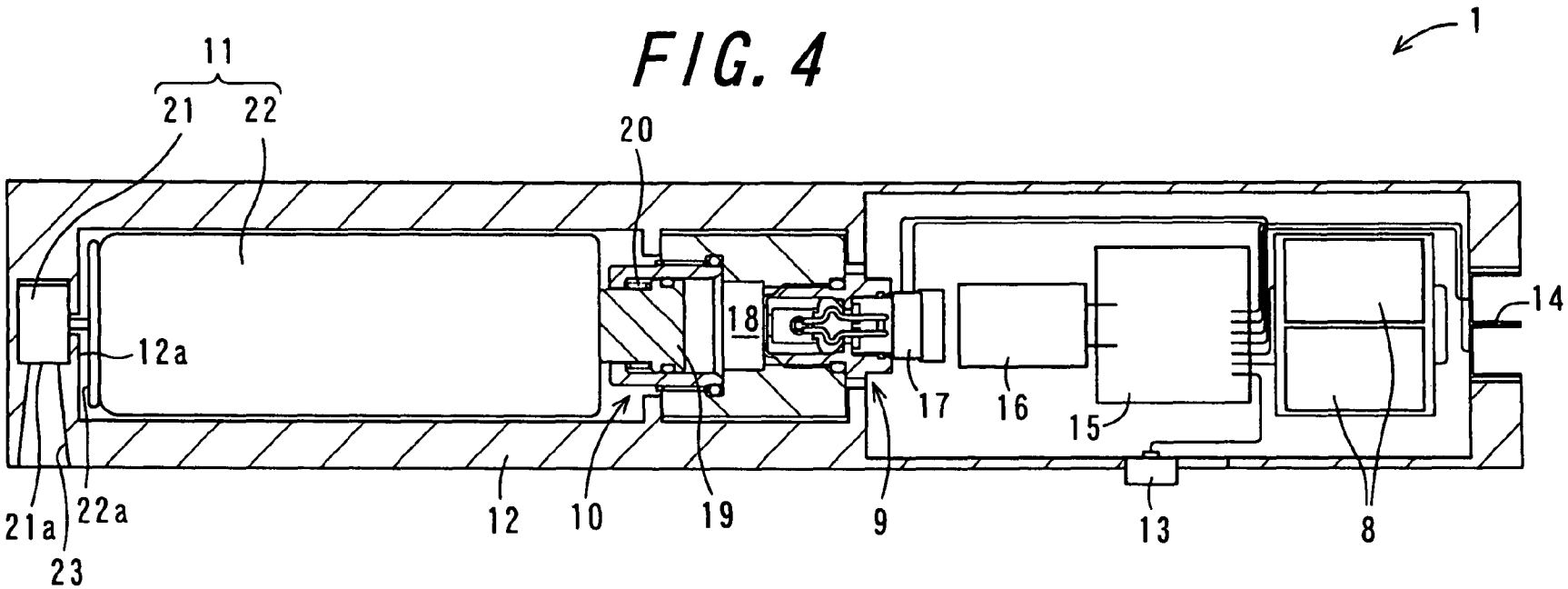
FIG. 4 is a cross-sectional view showing the odor-generating alarm apparatus.

FIG. 4 is a cross-sectional view showing the odor-generating alarm apparatus 1. Hereinafter, the mechanical configuration of the odor-generating alarm apparatus 1 will be described also with reference to FIGS. 1 and 2. The odor-generating alarm apparatus 1 further includes the casing 12 and a power source switch 13. This odor-generating alarm apparatus 1 is preferably used when disposed on the floor or hung from the wall. The casing 12 is made of a cylindrical member extending along a predetermined axis, and the internal portion thereof has an accommodation space that can accommodate the spray can 11 and an arrangement space that can accommodate other constituent elements. The arrangement space is formed adjacent to the accommodation space, and accommodates the power source portion 8, the driving portion 10, the initiator 9, and the circuit portion 7. Furthermore, the power source switch 13 is disposed on the outer circumferential portion of the casing 12, and can switch the state in which electricity is supplied from the power source portion 8 to the circuit portion 7.

The circuit portion 7 includes a terminal block 14, a circuit board 15, a capacitor 16, and a connector 17. The terminal block 14 is a portion that is electrically connected via a cable or the like to the sensor 4. As shown in FIG. 2, for example, the terminal block 14 is disposed at one end portion in the axial direction of the casing 12 so as to be exposed to the outside. The terminal block 14 is electrically connected to the circuit board 15. Thus, the abnormality information is supplied from the sensor 4 via the terminal block 14 to the circuit board 15.

The power source switch 13 is electrically connected to the circuit portion 7, and can switch the state of a voltage from the power source portion 8. The power source portion 8 is implemented by a battery 8 or the like, is detachably disposed on the odor-generating alarm apparatus 1, and can supply electrical power to the circuit board 15 when attached to the odor-generating alarm apparatus 1. The battery 8 is implemented, for example, by a primary battery such as a dry cell 8 or a secondary battery such as a rechargeable battery.

The circuit board 15 charges the capacitor 16 in advance with the electrical power supplied from the battery 8 so as to provide the energy necessary for igniting an explosive contained in the initiator 9. The circuit board 15 is electrically connected to the capacitor 16 and the connector 17. The circuit board 15 supplies the current discharged to the capacitor 16 to the connector 17 based on the abnormality information supplied from the terminal block 14. The connector 17 is electrically connected to the initiator 9, and operates the initiator 9 by supplying the current from the capacitor 16.

As described above, the initiator 9 is operated by the current supplied by the circuit portion 7 from the capacitor 16, and generates gas. The generated gas is released to a sealed space 18 defined by the casing 12, the initiator 9, and the driving portion 10, and increases the pressure in the sealed space 18. The air-tightness of this sort of sealed space 18 is maintained by an O-ring.

As described above, the driving portion 10 is operated by the gas generated by the initiator 9. The driving portion 10 includes a piston 19 and buffer means 20. The piston 19 defines the sealed space 18, and can be displaced along the axial direction of the casing 12 between a non-releasing position and a releasing position. The buffer means 20 buffers a shock generated when the spray can 11 displaces with respect to the casing 12. In this embodiment, the buffer means 20 is implemented by a spring member 20. The spring member 20 supplies a spring force so that the piston 19 displaces to one side (hereinafter, referred to as a "first side") in the axial direction.

The spray can 11 is detachably disposed in an accommodation space defined on the other side (hereinafter, referred to as a "second side") in the axial direction of the casing 12. The spray can 11 is filled with an odorous liquid and a compressed gas such as compressed air, and can release the odorous liquid in the form of fine particles by releasing the odorous liquid compressed by the compressed-gas from a thin opening of a nozzle head 21. The spray can 11 can be switched between a releasing state in which the odorous liquid is released and a non-releasing state. The spray can 11 is implemented, for example, by a compressed gas cylinder. The spray can 11 is substantially cylindrical, and disposed in the accommodation space so that the axis of the spray can 11 substantially matches that of the casing 12. The head portion of the spray can 11 is disposed on the second side in the axial direction of the casing 12. The spray can 11 includes the nozzle head 21 that releases the odorous liquid and a pressure container 22 that is filled with the odorous liquid and the compressed gas.

The nozzle head 21 that releases the odorous liquid filling the spray can 11 is disposed at the head portion of the spray can 11. The spray can 11 releases the odorous liquid by relatively displacing the nozzle head 21 and the pressure container 22 closer to each other. The pressure container 22 is disposed so as to be displaceable closer to the nozzle head 21 in the accommodation space. In the case where the spray can 11 is accommodated in the accommodation space and the spray can 11 is in the non-releasing state, an end wall portion 12*a* on the second side in the axial direction of the casing 12 that defines the accommodation space is away from an end face 22*a* of the pressure container 22 on the side facing the nozzle head 21. Furthermore, the nozzle head 21 is fixed to the casing 12 in the accommodation space in a state where the spray can 11 is accommodated in the accommodation space.

The casing 12 has a release opening 23 in a radial direction, which is the direction in which the odorous liquid is released from release aperture 21*a* of the nozzle head 21. The release opening 23 is tapered so as to expand outward in the radial direction. When the release opening 23 is tapered in this manner, the odorous liquid in the form of fine particles released from the nozzle head 21 can be efficiently dispersed without becoming attached to the inner circumferential face facing the release opening 23. The casing 12 and the driving portion 10 are made of a material that is not deformed in an undesirable manner by the pressure of the gas generated by the initiator 9, such as brass, stainless steel, synthetic resin, or the like.

Figure 5:
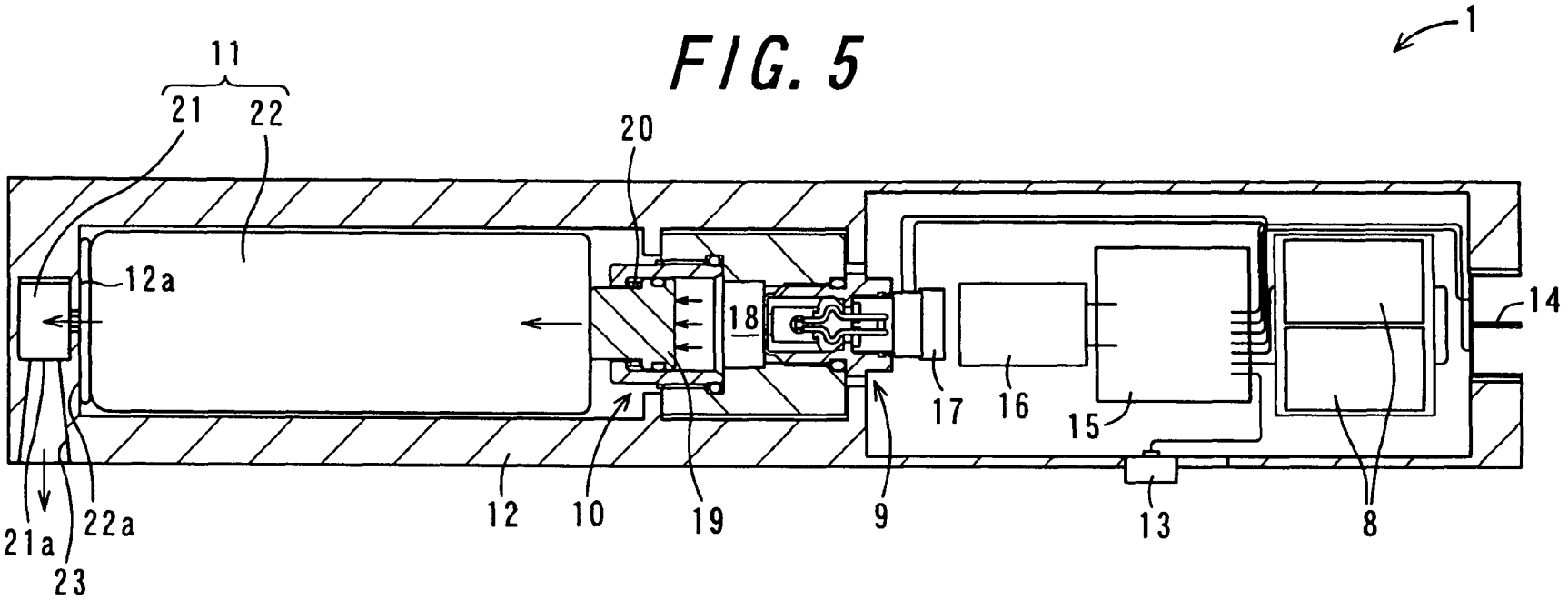
FIG. 5 is a cross-sectional view showing the odor-generating alarm apparatus in the case where the spray can is in the releasing state.

FIG. 5 is a cross-sectional view showing the odor-generating alarm apparatus 1 in the case where the spray can 11 is in the releasing state. In a natural state where the pressure from the initiator 9 has no influence, the piston 19 is positioned at a non-releasing position closer to the first side in the axial direction due to the spring force of the spring member 20 (see FIG. 4). When the gas generated by the initiator 9 increases the pressure in the sealed space 18 as described above, the pressure of the gas acts on the piston 19 and displaces the piston 19 from the non-releasing position, to the second side in the axial direction, to the releasing position (see FIG. 5) acting against the spring force of the spring member 20.

Displacement of the nozzle head 21 is restricted by the casing 12, and the pressure container 22 is disposed so as to be displaceable with respect to the casing 12 from a non-releasing can position that corresponds to the non-releasing state (see FIG. 4) to a releasing can position that corresponds to the releasing state (see FIG. 5). As shown in FIG. 4, in the state where the pressure container 22 is at the non-releasing can position and the piston 19 is at the non-releasing position, the bottom portion of the spray can 11 is in contact with the face portion of the piston 19 on the second side in the axial direction. As shown in FIG. 5, in the state where the piston 19 has been displaced to the releasing position, the piston 19 presses the bottom portion of the pressure container 22 to the second side in the axial direction, and displaces the pressure container 22 from the non-releasing can position, to the second side in the axial direction, to the releasing can position. Accordingly, the end wall portion 12*a* on the second side in the axial direction of the casing 12 is in contact with the end face 22*a* of the pressure container 22 on the side facing the nozzle head 21. Since the nozzle head 21 is fixed to the casing 12, when the pressure container 22 displaces with respect to the nozzle head 21 in a direction closer to the releasing can position, the odorous liquid is released from the nozzle head 21. Since the gas generated by the initiator 9 is present in the sealed space 18, the pressure of the gas displaces the piston 19 to the releasing position (see FIG. 5) and maintains this state. Accordingly, the state in which the pressure container 22 is at the releasing can position is maintained, and thus, the odorous liquid is continuously released from the nozzle head 21.

An odorous agent of the above-described odorous liquid filling the spray can 11 is selected in consideration of the purpose to give notice of an abnormal state and urge people to evacuate. The odorous agent is made of, for example, a material mainly containing an agent having a mint odor and a Japanese horseradish odor. Furthermore, as the gas filling the spray can 11, a gas nonflammable even in the presence of a flame or air is selected.

Furthermore, the spray can 11 may generate an odorous gas through a chemical change of the odorous agent, and use propelling power thereof to spray the odorous substance. The pressure of the gas generated by the chemical reaction of the odorous agent can gasify the odorous liquid. When the odorous liquid is dispersed in the form of a mist in this manner, the odorous liquid can be dispersed over a wide area in a short time.

The amounts of odorous liquid and compressed gas filling the spray can are selected based on the volume of the installation space in which the odor-generating alarm apparatus 1 is installed. The amounts are selected so that, when the spray can 11 is set to the releasing state, the odorous liquid filling the spray can is sufficiently dispersed in the installation space without a shortage, and people and the like in the installation space notice the odor.

As described above, in the odor-generating alarm apparatus 1 of this embodiment, when abnormality information indicating the occurrence of an abnormal state is supplied from the sensor 4 that detects the occurrence of an abnormal state, the circuit portion 7 operates the initiator 9. The initiator 9 displaces the piston 19 of the driving portion 10, thereby displacing the spray can 11 with respect to the casing 12. Accordingly, the spray can 11 can be switched to the releasing state, and the odorous liquid filling the spray can 11 can be released in the form of fine particles. Thus, when a fire or another abnormal state occurs, the odorous liquid filling the spray can 11 can be released. In the case where the spray can 11 is used in this manner, the odorous liquid can be made in the form of fine particles due to the compressed gas and dispersed over a wider area compared with the case where a tube-like container or the like is filled with the odorous liquid. Furthermore, the driving portion 10 sets the spray can 11 to the releasing state by displacing the spray can 11 with respect to the casing 12, and thus, the spray can 11 can continuously release the odorous liquid. Thus, a desired amount of odorous liquid can be released. Accordingly, the odorous liquid can be reliably dispersed in a short time to people that have to evacuate from an abnormal state, and the people can immediately recognize the abnormal state. Thus, for example, with the odorous gas, even hearing-impaired people and animals such as domestic animals can recognize the occurrence of a fire or another abnormal state, and immediately evacuate from that site. Furthermore, in the case where sensors corresponding to targets that are to be detected by the sensor 4 are applied, the odor-generating alarm apparatus 1 can be extensively used as an alarm apparatus not only for a fire but also for any other dangers and abnormal states.

Moreover, in this embodiment, the switching means for performing a switching operation from the non-releasing state to the releasing state by displacing the spray can 11 with respect to the casing 12 is implemented by including the initiator 9. The initiator 9 generates gas by igniting an explosive, and uses the pressure of the gas to displace the spray can 11. When an explosive is ignited in this manner, gas can be generated in an extremely short time, and thus, the response to abnormality information can be improved. Furthermore, when an explosive is used, a failure in the switching operation due to corrosion or the like can be prevented, and the switching operation can be more reliably performed, compared with the case in which the switching means is configured from a mechanical constituent element.

In the case where the switching means includes the initiator 9, an explosive is preferably ignited when the internal structure of the initiator 9 is exposed through illicit means. Accordingly, the explosive contained in the initiator 9 can be prevented from being taken out through illicit means. Accordingly, the explosive contained in the initiator 9 can be prevented from being used for another purpose, and safety can be improved. An operation that opens and closes the casing 12 through illicit means can be detected, for example, by a limit switch.

Moreover, in this embodiment, a shock generated when the spray can 11 displaces with respect to the casing 12 is buffered by the spring member 20 functioning as the buffer means 20, and thus, it is possible to prevent the spray can 11 from being damaged during the switching operation. Accordingly, even in the case where the spray can 11 is rapidly displaced using an explosive as described above, it is possible to prevent the spray can 11 from being damaged, and to cause the initiator 9 and the driving portion 10 to reliably switch the spray can 11 to the releasing state.

Moreover, in this embodiment, safety in a normal state can be secured by using a spray can 11 that does not cause an explosion when heated. Furthermore, extended storage properties can be secured by filling the spray can 11 with the odorous liquid.

Moreover, in this embodiment, the casing 12 and the spray can 11 may be configured so that one end portion of the spray can 11 on the side of the nozzle head 21 is fixed to the casing 12, and the odorous liquid is released by pressing the other end portion toward the nozzle head 21. Since displacement of the pressure container 22 over the releasing can position further toward the nozzle head 21 is restricted by the casing 12 in this manner, the load acting on the nozzle head 21 during the releasing operation can be reduced. Thus, the nozzle head 21 can be prevented from being damaged by the pressure of the initiator 9, and the odorous liquid can be reliably released during an abnormal state. Furthermore, since the nozzle head 21 is fixed to the casing 12, the nozzle head 21 does not displace with respect to the casing 12 in an undesirable manner, and thus, the odorous liquid can be released in a desired releasing direction.

In the foregoing embodiment, the odor-generating alarm apparatus 1 is implemented by an apparatus separated from the alarm bell 5 and the alarm lamp 6, but there is no limitation to this. Sound-generating means functioning as the alarm bell 5, such as a buzzer, and light-generating means functioning as the alarm lamp 6 may be incorporated in the odor-generating alarm apparatus 1. In the case where notifying means functioning as other alarm means 5 and 6 is incorporated in the odor-generating alarm apparatus 1 in this manner, whether or not an odor is an odor released by the odor-generating alarm apparatus 1 can be confirmed by visually confirming the odor-generating alarm apparatus 1 when noticing the odor. Accordingly, even hearing-impaired people can reliably recognize the state in which an alarm is on, by visually confirming the odor-generating alarm apparatus 1 after noticing the odor.

Moreover, in the foregoing embodiment, the alarm means includes the odor-generating alarm apparatus 1, the alarm bell 5, and the alarm lamp 6, but there is no limitation to this. The alarm means needs only include at least the odor-generating alarm apparatus 1, and may be combined with another alarm means as appropriate.

Moreover, in the foregoing embodiment, the sensor 4 and the odor-generating alarm apparatus 1 are electrically connected to each other via the fire-extinguishing apparatus 3 via wired communication, but there is no limitation to wired communication. The abnormality information may be received via wireless communication.

Furthermore, the odor-generating alarm apparatus 1 may be integrated with a fire-extinguishing apparatus 3 that uses a colorless and odorless gas, such as carbon dioxide. The odor-generating alarm apparatus 1 is controlled so as to spray carbon dioxide and to generate odor in the area in which carbon dioxide is sprayed. Accordingly, the odor can prevent people from entering the area filled with carbon dioxide, because people may be suffocated by the carbon dioxide.

Moreover, in the foregoing embodiment, the case was described in which the odor-generating alarm apparatus 1 is electrically connected to the fire-extinguishing apparatus 3, but there is no limitation to this configuration. The abnormality information may be supplied through the configuration in which the odor-generating alarm apparatus 1 is electrically connected to other alarm means 5 and 6 that are electrically connected to the fire-extinguishing apparatus 3. Furthermore, the odor-generating alarm apparatus 1 may be configured so that a sound generated by the alarm bell 5 when the alarm bell 5 operates is detected, the sound is regarded as the abnormality information, and odor is generated.

Furthermore, the odorous liquid in the form of fine particles and the gas released from the spray can 11 may be colorless or may be colored. In the case where the liquid or the gas released from the spray can 11 is colored, whether or not an odor is an odor released by the odor-generating alarm apparatus 1 can be confirmed by visually confirming the odor-generating alarm apparatus 1 when noticing the odor. Accordingly, even hearing-impaired people can reliably recognize the state in which an alarm is on, by visually confirming the odor-generating alarm apparatus 1 after noticing the odor.

Moreover, in the foregoing embodiment, the buffer means 20 is implemented by the spring member 20, but there is no limitation to this configuration. For example, an orifice may be formed in the piston 19 forming the driving portion 10, and a shock may be absorbed through the exhaustion of fluid frictional energy occurring when the gas generated by the initiator 9 passes through the orifice. Furthermore, the buffer means 20 may be implemented by an attenuator, such as a damper. Furthermore, there is no limitation to the configuration in which the buffer means 20 is integrated with the switching means. The spray can 11 may alleviate a shock generated by displacement. Thus, for example, a spring member may be disposed close to the pressure container 22 of the spray can 11 so that the spring force acts in the direction opposite to the direction in which the spray can 11 displaces from the non-releasing state to the releasing state.

Furthermore, a configuration may be applied in which the odorous liquid can be manually released from the spray can 11 in a state where the spray can 11 is attached to the casing 12. With this configuration in which the odorous liquid can be manually released from the spray can 11, an operator can confirm the odor of the odorous liquid in advance. Thus, the operator can recognize in advance the odor released from the odor-generating alarm apparatus 1 in an abnormal state.

Furthermore, the casing 12 may be configured so that the spray can 11 can be displaced so as to manually set the spray can 11 to the non-releasing state in the case where the spray can 11 is at the releasing can position. With this configuration, in the case where the sensor 4 erroneously operates or the case where such operation is regularly confirmed, the release can be stopped after a desired amount of odorous liquid is released. Thus, the odorous liquid can be prevented from being uselessly released.

Furthermore, the switching means is implemented by the driving portion 10 and the initiator 9, but there is no limitation to this configuration. The spray can 11 may be displaced by driving means, such as a motor or a solenoid. Furthermore, the switching means may displace the spray can 11, using the pressure generated when a liquid is gasified by a chemical reaction or heat, or using a spring force.

Furthermore, dispersing means, such as a propeller, may be integrally or separately disposed so that the odorous liquid released from the spray can 11 is dispersed in a shorter time.

Furthermore, the release opening 23 is formed in the casing 12, but the casing 12 may be configured so that this sort of release opening 23 is not disposed and the release aperture 21*a* of the nozzle head 21 is directly exposed to the outside. When the release aperture 21*a* of the nozzle head 21 is exposed to the outside in this manner, the number of obstacles that prevent the odorous liquid from being dispersed can be reduced, and dispersibility can be further improved.

Furthermore, a substance that changes in color when the odorous liquid is attached thereto may be applied in advance to the wall portion of the casing 12 facing the release opening 23. When this sort of substance is applied, whether or not the odorous liquid has been released from the spray can 11 can be easily confirmed by a third person through visual confirmation. This sort of substance is implemented, for example, by a water-soluble ink.

Figure 6:
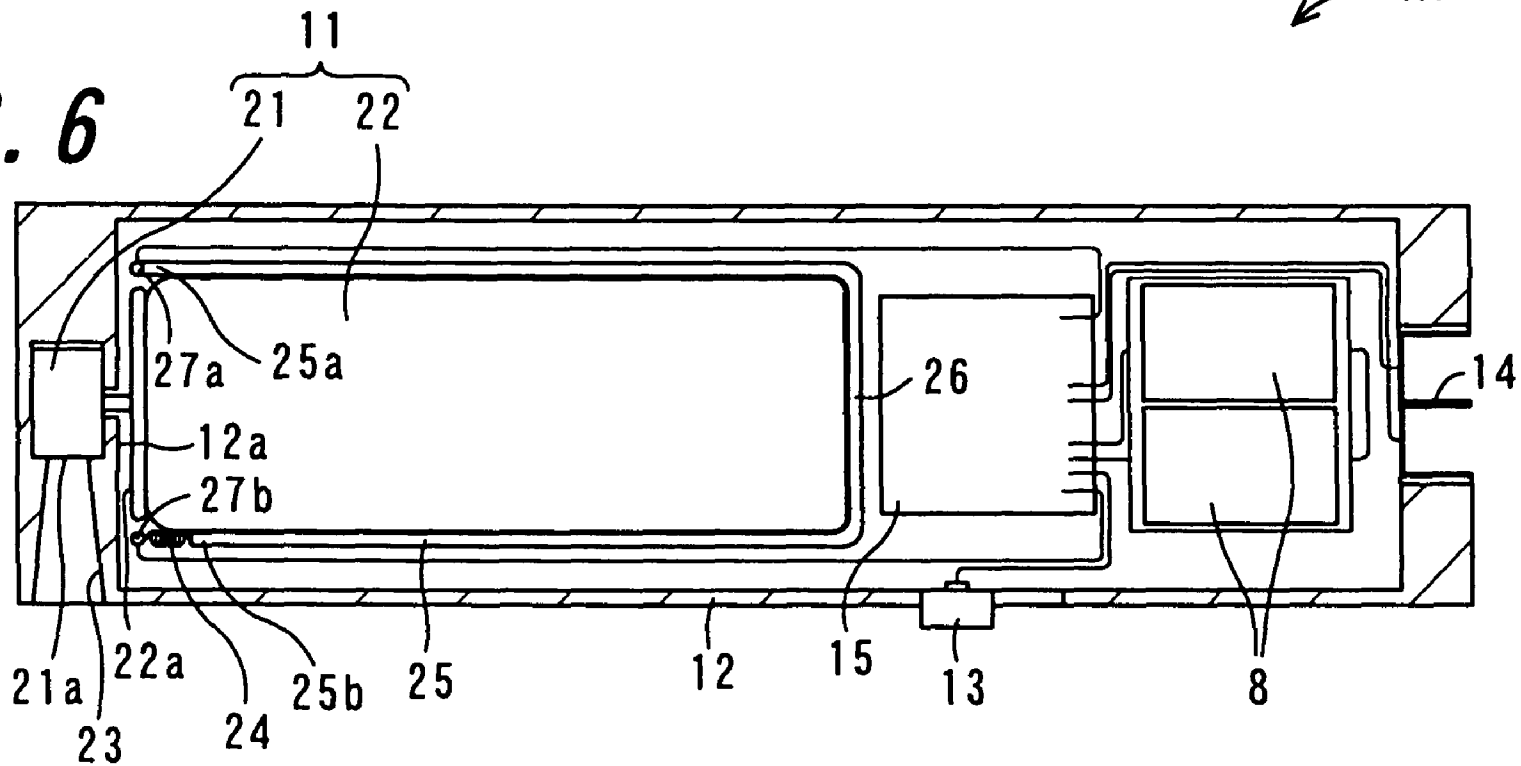
FIG. 6 is a cross-sectional view showing the odor-generating alarm apparatus according to a second embodiment of the invention.
Figure 7:
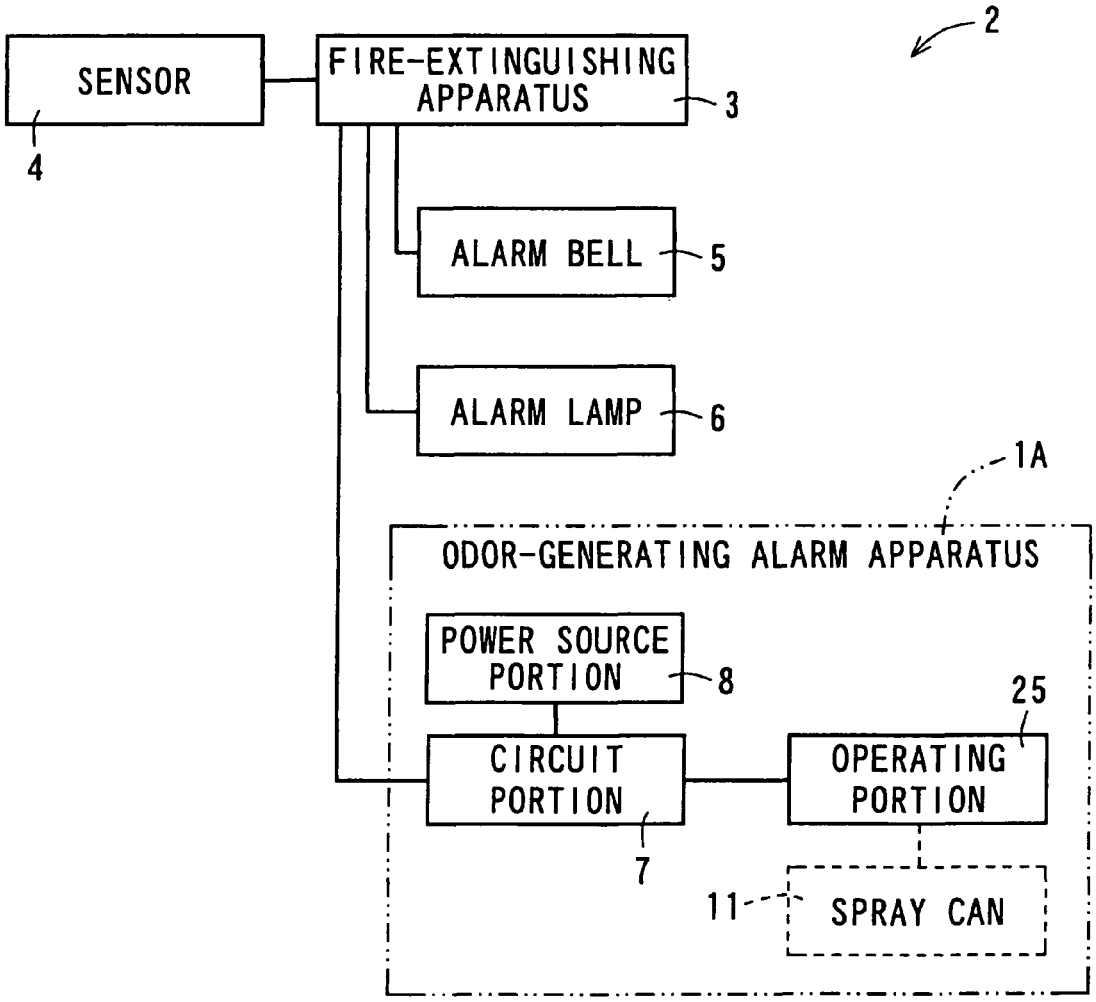
FIG. 7 is a block diagram showing the electrical configuration of an alarm system including the odor-generating alarm apparatus.

Now, an odor-generating alarm apparatus 1A according to a second embodiment of the invention will be described. FIG. 6 is a cross-sectional view showing the odor-generating alarm apparatus 1A according to the second embodiment of the invention. FIG. 7 is a block diagram showing the electrical configuration of an alarm system 2 including the odor-generating alarm apparatus 1A. In the odor-generating alarm apparatus 1A of this embodiment, the switching means includes a pulling member 24, and an operating portion 25 made of a material that is contracted by the application of electricity, such as, in this embodiment, a shape memory alloy.

As shown in FIGS. 6 and 7, the odor-generating alarm apparatus 1A includes the operating portion 25 and the pulling member 24 functioning as the switching means. When the abnormality information is supplied from the sensor 4, the circuit portion 7 operates the operating portion 25. The circuit portion 7 is electrically connected to the operating portion 25, and applies electricity to the operating portion 25 when the abnormality information is supplied from the sensor 4. The operating portion 25 is made of a shape memory alloy in this embodiment, and contracted by the application of electricity. The pulling member 24 applies a constant load to the operating portion 25. In this embodiment, the operating portion 25 is contracted in the axial direction by the application of electricity and extended in the axial direction by stopping the application of electricity. Thus, the operating portion 25 repeats the operation in two directions in the axial direction depending on the presence or absence of the application of electricity.

As shown in FIG. 6, the operating portion 25 is disposed along the outer circumference of the spray can 11 so as to be substantially in a U-shape when viewed from the outer side in the radial direction of the spray can 11. In the operating portion 25, a bottom portion 26 of the substantial U-shape is positioned at the bottom portion of the spray can 11. Thus, two end portions 25*a* and 25*b* of the operating portion 25 are arranged at two different positions 27*a* and 27*b* close to the outer positions in the radial direction of the head portion of the spray can 11. One end portion 25*a* of the operating portion 25 is fixed to one position 27*a* of the two different positions 27*a* and 27*b*. The other end portion 25*b* of the operating portion 25 is linked to the pulling member 24 disposed at the other position 27*b* of the two different positions 27*a* and 27*b*. In the operating portion 25, one end portion 25*a* is electrically connected to the circuit portion 7, and the other end portion 25*b* is electrically connected via the pulling member 24 to the circuit portion 7. Thus, when the length of the operating portion 25 is reduced by the application of electricity, the distance from the two end portions 25*a* and 25*b* to the bottom portion 26 substantially in a U-shape is reduced because the two end portions 25*a* and 25*b* are fixed. Furthermore, the operating portion 25 preferably has insulating properties. In this embodiment, the operating portion 25 is used in a state coated with an insulating material. Accordingly, in the case where electricity is applied to the operating portion 25, even when the operating portion 25 is brought into contact with another conductive member such as the pressure container 22, a current can be prevented from flowing through the pressure container 22 in an undesirable manner.

The pulling member 24 is linked to the other end portion 25*b* of the operating portion 25 made of linear wires, and applies a predetermined constant load in the pulling direction. Furthermore, the pulling member 24 has a function of providing an allowance, and can improve the work efficiency of attaching the operating portion 25. The pulling member 24 is implemented by a coil spring in this embodiment, and made of a conductive material. Furthermore, in this embodiment, the pulling member 24 is used in a state coated with an insulating material. Accordingly, in the case where electricity is applied to the operating portion 25, even when the pulling member 24 is brought into contact with another conductive member such as the pressure container 22, a current can be prevented from flowing through the pressure container 22 in an undesirable manner.

Figure 8:
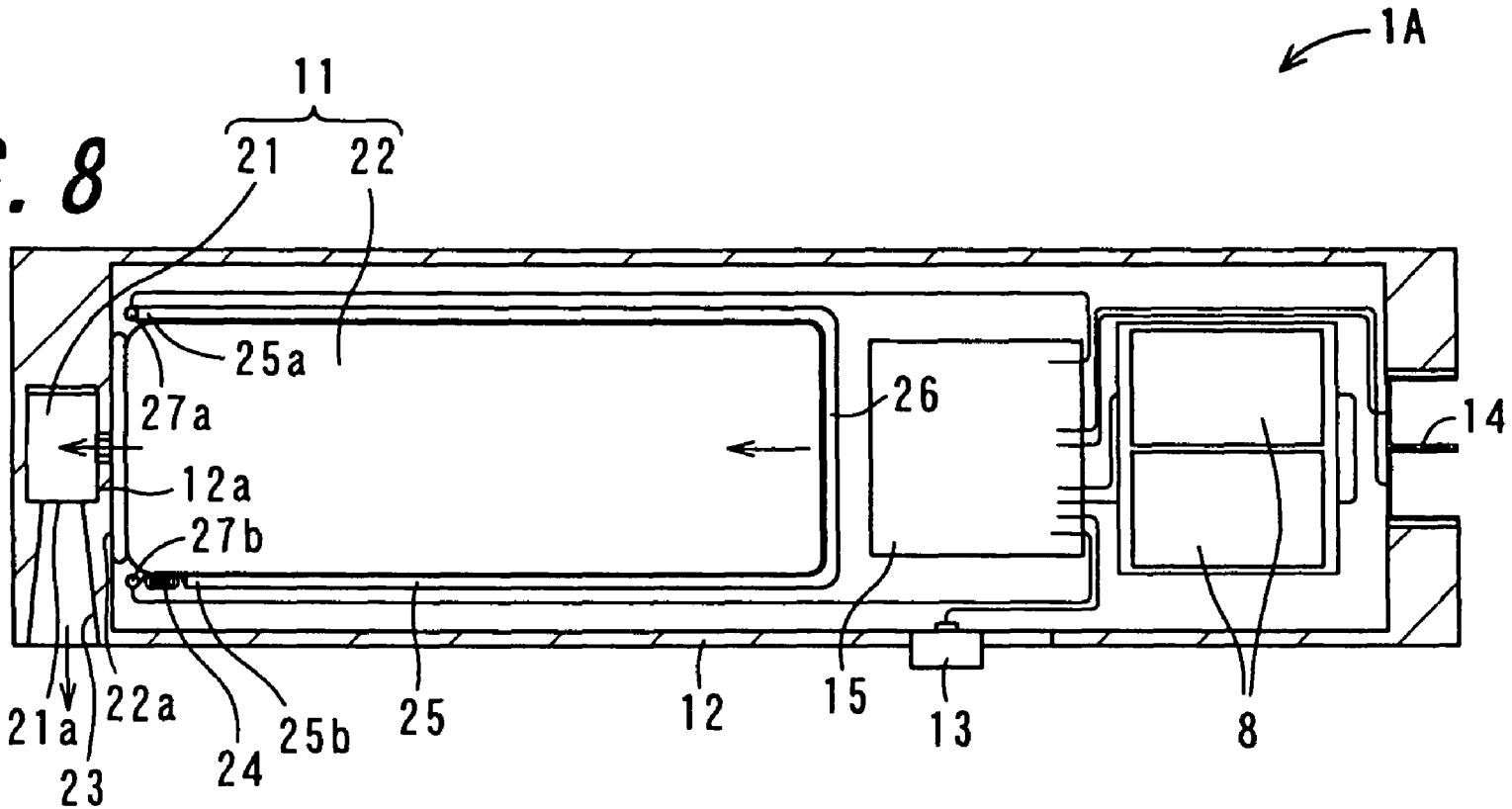
FIG. 8 is a cross-sectional view showing the odor-generating alarm apparatus in the case where the spray can is in the releasing state.

FIG. 8 is a cross-sectional view showing the odor-generating alarm apparatus 1A in the case where the spray can 11 is in the releasing state. In a state where electricity is not applied to the operating portion 25, the spray can 11 is positioned at a non-releasing can position closer to the first side in the axial direction (see FIG. 6). As described above, when electricity is applied to the operating portion 25 in the state shown in FIG. 6, the length of the operating portion 25 is reduced, and thus, the pressure container 22 of the spray can 11 displaces from the non-releasing can position to the second side in the in the axial direction to the releasing can position (see FIG. 8). Since the nozzle head 21 is fixed to the casing 12, when the pressure container 22 displaces with respect to the nozzle head 21 in a direction closer to the releasing can position, the odorous liquid is released from the nozzle head 21. Since the length of the operating portion 25 is kept small during the application of electricity, the state in which the pressure container 22 is at the releasing can position is maintained, and the odorous liquid is continuously released from the nozzle head 21.

A material that is contracted by the application of electricity, used for this sort of operating portion 25, is selected at least based on the following three selection factors. As a first selection factor, it is necessary that the amount of extension and contraction in the case where electricity is applied is at least the distance from a can position in which the odorous liquid is released to a can position in which the release is stopped, such as, for example, 3 mm. The reason for this is that, in the case where the amount of extension and contraction is shorter than this distance, the odorous liquid cannot be released from the spray can 11 even by the application of electricity to the operating portion 25. As a second selection factor, it is necessary that the odorous liquid can be released at a predetermined current or lower. The reason for this is that this configuration makes it possible for the operating portion 25 to operate even when the current supplied from the power source portion 8 is low. As a third selection factor, it is necessary that the material has a predetermined tensile force. The reason for this is that a force that can displace the pressure container 22 from a non-releasing can position in which the nozzle head 21 is in the natural state to a position in which the nozzle head 21 can release the odorous liquid is necessary when electricity is applied to the operating portion 25. This tensile force is, for example, 15 N (1.5 kgf) or more. Based on such selection factors, the diameter, the number, and the material of an operating portion 25 are selected as appropriate. The operating portion 25 is implemented, for example, by two or more wires made of NiTiCu shape memory alloy containing 49.0 to 51.0 at % of Ti, 5.0 to 12.0 at % of Cu, and Ni as the balance, in which the wire diameter is 200 μm, the operating current is 1A, the maximum load applied is 12 N (1.2 kgf), and the practical operating strain is 5%.

As described above, in this embodiment, the switching means further includes an operating portion 25 made of a material that is contracted by the application of electricity, such as, in this embodiment, a shape memory alloy. The circuit portion 7 heats the operating portion 25 by the application of electricity, and uses the heat to deform the operating portion 25, thereby displacing the spray can 11. It is possible to displace the spray can 11 with a simple configuration in which electricity is applied to the operating portion 25 in this manner. Thus, the switching means can be made smaller and lighter.

In the case where the switching means is configured from the initiator 9 as in the foregoing embodiment, the initiator 9 has to be changed after each operation. However, in the case where the switching means is made of a material that is contracted by the application of electricity as in this embodiment, this switching means can be used more than a single time, and repeatedly used.

Furthermore, the circuit portion 7 may include a timer. Accordingly, when the abnormality information is supplied from the sensor 4, the circuit portion 7 can operate the operating portion 25 for a period of time predetermined based on the timer, such as, for example, 30 seconds. Accordingly, other members can be prevented from being damaged by the temperature of the operating portion 25 or the cells 8 being increased in an undesirable manner by the application of electricity to the operating portion 25 for a long time. Also, in the case where the operation is performed for a predetermined period of time, a necessary amount of odorous liquid can be released from the spray can 11.

Moreover, in this embodiment, the operating portion 25 is disposed so as to press the bottom portion of the pressure container 22 toward the nozzle head 21, but there is no limitation to this configuration. The nozzle head 21 may be pressed toward the pressure container 22.

Moreover, in this embodiment, the material that is contracted by the application of electricity is implemented by a shape memory alloy, but there is no limitation to a shape memory alloy. It is also possible to use another material that has a function of being contracted by the application of electricity. Furthermore, there is no limitation to a material that is contracted by the application of electricity. It is also possible to use another material that has a function of being extended and contracted by the application of electricity.

Furthermore, in the case where the operating portion 25 is implemented by linear wires, a portion of the operating portion 25 pressing the spray can 11 (the bottom portion 26 of the spray can 11 in this embodiment) may be fixed by fixing means to the spray can 11 so that the operating portion 25 is not separated from the portion of the spray can 11 pressed. The fixing means may be implemented, for example, by a recess portion to which the operating portion 25 is fitted, a C-shaped hook portion on which the operating portion 25 is hooked, or the like. Accordingly, when electricity is applied to the operating portion 25, the operating portion 25 can reliably press the spray can 11.

Figure 9:
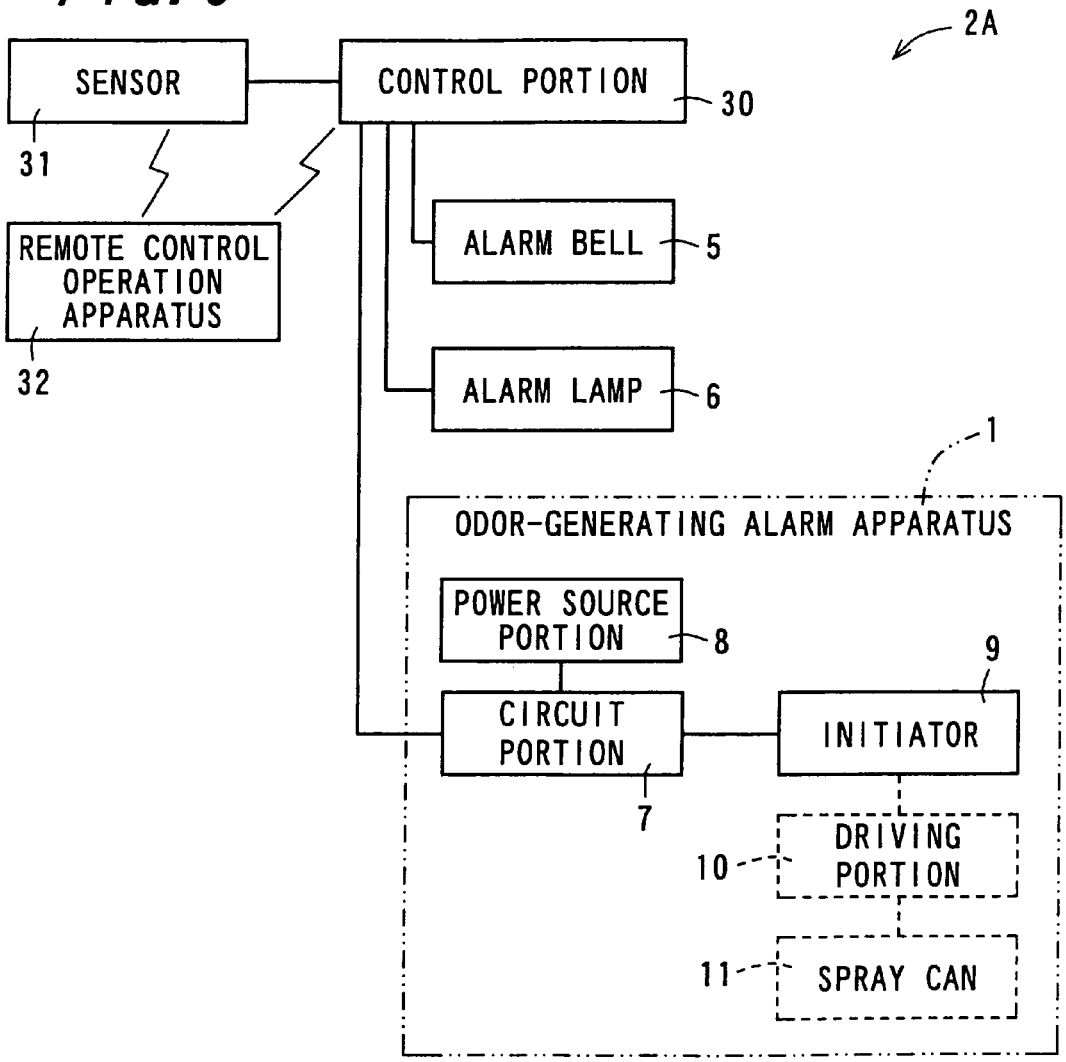
FIG. 9 is a block diagram showing the electrical configuration of the alarm system according to a third embodiment of the invention.

Now, an alarm system 2A according to a third embodiment of the invention will be described. The alarm system 2A of this embodiment is a system that exercises surveillance over a surveillance area, and raises an alarm upon detecting an abnormal state, such as the intrusion of a suspicious individual into the surveillance area. The surveillance area may be, for example, establishments where gaming machines are installed, banks, schools, sales offices, parks, the driver's seats of vehicles, the backseats of taxies, garbage collection locations, or the like. FIG. 9 is a block diagram showing the electrical configuration of the alarm system 2A according to this embodiment. The alarm system 2A includes a control portion 30, a sensor 31, a remote control operation apparatus 32, the odor-generating alarm apparatus 1, the alarm bell 5, and the alarm lamp 6.

The sensor 31 is detecting means, and detects the state in a surveillance area and supplies detected information obtained by this detection to the control portion 30. For example, the sensor 31 detects the intrusion of a suspicious individual into the surveillance area. The sensor 31 is implemented, for example, by a heat sensor, a motion sensor, a weight sensor, or a security camera. The sensor 31 supplies the detected information to the control portion 30 and the remote control operation apparatus 32.

The remote control operation apparatus 32 is disposed at a location away from the surveillance area, and is electrically connected to the sensor 31 and the control portion 30. The remote control operation apparatus 32 is electrically connected to the sensor 31 and the control portion 30, for example, via wireless communication. Upon determining that an intruder is present in the surveillance area based on the detected information supplied from the sensor 31, the remote control operation apparatus 32 supplies the abnormality information to the control portion 30. Furthermore, the remote control operation apparatus 32 includes input means (not shown). When an operator operating the remote control operation apparatus 32 determines that a suspicious individual is present based on an image from the security camera or the like, the operator operates the input means to supply the abnormality information to the control portion 30.

The control portion 30 is electrically connected to the sensor 31 and the remote control operation apparatus 32, and controls the odor-generating alarm apparatus 1, the alarm bell 5, and the alarm lamp 6 to raise an alarm as in the foregoing embodiment upon determining that an intruder is present in the surveillance area based on the detected information supplied from the sensor 31. Furthermore, the control portion 30 controls the odor-generating alarm apparatus 1, the alarm bell 5, and the alarm lamp 6 to raise an alarm when such abnormality information is supplied from the remote control operation apparatus 32.

The odor-generating alarm apparatus 1 is disposed at a position where odor can be generated in the surveillance area in which the intrusion of a suspicious individual has been detected. Furthermore, the odor-generating alarm apparatus 1 is disposed at a position on the route through which the suspicious individual will run away, for example, at a position close to the entrance linked to the surveillance area. Accordingly, the odor generated by the odor-generating alarm apparatus 1 is reliably supplied to the suspicious individual.

The spray area in which the odor-generating alarm apparatus 1 generates odor is set as appropriate according to the properties of the surveillance area. Furthermore, the position at which the odor-generating alarm apparatus 1 is disposed is set as appropriate according to the properties of the surveillance area. In establishments where gaming machines are installed, the surveillance area is set so as to prevent the gaming machines from being abusively used. For example, an odor-generating alarm apparatus 1 is disposed at each gaming machine. Furthermore, the spray area is set so as to have directivity so that odor is generated toward an operator operating a gaming machine and that the odor is not dispersed toward operators operating adjacent gaming machines. Accordingly, the odor-generating alarm apparatus 1 can generate odor toward an operator operating a gaming machine that is being abusively used, upon detecting such abuse of a gaming machine.

Furthermore, in banks, sales offices, and the like, the surveillance area is set so as to prevent cash from being stolen from a counter, a safe, or a cash register. For example, an odor-generating alarm apparatus 1 is disposed at each counter, safe, or cash register. Accordingly, the odor-generating alarm apparatus 1 can generate odor toward a burglar upon detecting the possibility of the theft of cash or other items. Furthermore, for example, a surveillance area is set over the driver's seat of a vehicle or the backseat of a taxi, and the odor-generating alarm apparatus 1 is disposed so as to prevent the vehicle from being stolen or to prevent robbery in the taxi.

Furthermore, the control portion 30 may perform control so as to cause the odor-generating alarm apparatus 1 to generate odor in a stepwise manner according to the detected information. Accordingly, a warning can be given with a light spray before a suspicious individual performs an abusive action, and the continuation of such abusive action can be stopped with a strong spray in the case where the abusive action continues regardless of the warning. Accordingly, odor can be generated in a stepwise manner according to the action of a suspicious individual, and thus, convenience is improved.

An odorous agent of the odorous liquid filling the spray can 11 is preferably an agent that prevents a suspicious individual from continuing an abusive action. As in the foregoing embodiment, the odorous agent may be made of, for example, a material mainly containing an agent having a mint odor and a Japanese horseradish odor. Furthermore, it is also possible to use a stimulant, such as chloroacetophenone, chlorobenzylidenamalononitrile, and capsaicin.

Furthermore, the spray can 11 may be filled not only with the odorous agent but also with a dye. Accordingly, odor is generated and the dye is sprayed toward a suspicious individual, and thus, the dye can be attached to the suspicious individual. Accordingly, the suspicious individual can be easily identified, and the effect on security can be improved. As this sort of dye, a dye that cannot be easily washed out when attached to clothes or the skin is preferably used.

In this embodiment, the alarm system 2A includes the remote control operation apparatus 32, but there is no limitation to this. The alarm system 2A may be configured from the remaining portion excluding the remote control operation apparatus 32. Furthermore, there is no limitation to the configuration in which the remote control operation apparatus 32 is disposed at a location away from the odor-generating alarm apparatus 1. For example, input means functioning as the remote control operation apparatus 32 may be disposed at a bank counter, and a clerk at the counter may operate the input means to supply the abnormality information to the control portion 30 in the case where a suspicious individual comes to the counter. Accordingly, the odor-generating alarm apparatus 1 can be remotely controlled.

Moreover, in this embodiment, the remote control operation apparatus 32, and the sensor 31 and the control portion 30 are electrically connected to each other via wireless communication, but there is no limitation to wireless communication and wired communication can be also used. Any configuration may be applied as long as information containing the abnormality information can be transmitted and received. In a similar manner, the control portion 30 is electrically connected to the sensor 31, the odor-generating alarm apparatus 1, the alarm bell 5, and the alarm lamp 6 via wired communication, but there is no limitation to wired communication and wireless communication can be also used. Any configuration may be applied as long as information containing the abnormality information can be transmitted and received.

The control portion 30 may store operation information of the odor-generating alarm apparatus 1, such as at least one of the number of operations and the duration of an operation. Accordingly, the control portion 30 can calculate the remaining amount of odor filling the spray can 11 of the odor-generating alarm apparatus 1. In the case where the control portion 30 controls constituent elements to give notice of the remaining amount of odor, the operator can notice the remaining amount of odor and change the spray can 11 as appropriate.

Furthermore, the type of odor is not limited to one type, and the odor-generating alarm apparatus 1 may be able to generate a plurality of types of odor or gas. Accordingly, different types of odor can be used respectively according to the purposes. Furthermore, with a configuration in which a gas that neutralizes an odor can be generated, the odor-generating alarm apparatus 1 can smoothly neutralize the odor when the user wants to immediately neutralize the odor.

Furthermore, the odor-generating alarm apparatus 1 may be disposed in an unpleasant area in which an unpleasant odor is easily generated, such as a lavatory or a smoking area. The sensor 31 is disposed at the entrance of an unpleasant area, for example, the entrance of a lavatory, and, when the sensor 31 detects a user, the control portion 30 controls the odor-generating alarm apparatus 1 so as to generate odor in the unpleasant area. In the case where the odor-generating alarm apparatus 1 is filled in advance with a deodorant component having a deodorizing effect and a mint odor or the like, an unpleasant odor in the unpleasant area can be deodorized. Furthermore, the control portion 30 may control the odor-generating alarm apparatus 1 so as to regularly generate odor, and may control the odor-generating alarm apparatus 1 based on information other than that indicating the entry of a user into an unpleasant area, such as the concentration of odor and the concentration of smoke.

Furthermore, the odor-generating alarm apparatus 1 may be used for waking a person up as an alarm clock apparatus. When the odor-generating alarm apparatus 1 is filled with an aromatic odorous agent, and generates odor based on a timer, the odor-generating alarm apparatus 1 can be used as an alarm clock apparatus. Furthermore, the odor-generating alarm apparatus 1 may be disposed inside a vehicle, and used for preventing drowsy driving. With the control in which, when the sensor 31 detects drowsy driving and drowsiness of the driver, the odor-generating alarm apparatus 1 generates odor, the driver can be woken up, and the driver can be urged to drive the vehicle safely. Examples of the information used by the sensor 31 to detect drowsiness in a driver include an increase in the temperature of the driver, excessive speed, driving in a zigzag line, distance between vehicles, and the like.

Furthermore, the odor-generating alarm apparatus 1 may be integrated with a self-contained breathing apparatus. The odor-generating alarm apparatus 1 is controlled so as to generate odor at the face portion, when a pressure indicator of the self-contained breathing apparatus indicates a value not greater than a predetermined pressure, for example, 3 MPa. Accordingly, with the odor, the user wearing the self-contained breathing apparatus can recognize that the pressure indicator indicates a value not greater than the predetermined pressure. Thus, the remaining amount indicated by the pressure indicator can be recognized, and the user can be guided to a safe location.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, when abnormality information indicating the occurrence of an abnormal state is supplied from detecting means for detecting the occurrence of an abnormal state, control means causes switching means to perform a switching operation. The switching means can perform the switching operation to a releasing state by displacing a spray can with respect to a casing, thereby releasing an odorous liquid filling the spray can. Thus, when a fire or another abnormal state occurs, the odorous liquid filling the spray can be released. In the case where the spray can is used in this manner, the odorous liquid can be dispersed over a wider area compared with the case where a tube-like container or the like is filled with the odorous liquid. Furthermore, the switching means can maintain the releasing state by displacing the spray can with respect to the casing, and thus, the spray can continuously release the odorous liquid. Thus, a desired amount of odorous liquid can be released. Accordingly, the odorous liquid can be reliably dispersed in a short time to people that have to evacuate from an abnormal state, and the people can immediately recognize the abnormal state. Thus, with the odorous gas, even hearing-impaired people can recognize the occurrence of a fire or another abnormal state, and immediately evacuate from that site.

According to the invention, the switching means further includes an operating portion made of a material that is extended and contracted by the application of electricity. The control means displaces the spray can by applying electricity to the operating portion. It is possible to displace the spray can with a simple configuration in which electricity is applied to the operating portion in this manner. Thus, the switching means can be made smaller and lighter.

According to the invention, the switching means generates gas by igniting an explosive, and uses the pressure of the gas to displace the spray can. When an explosive is ignited in this manner, gas can be generated in an extremely short time, and thus, the response to abnormality information can be improved. Furthermore, when an explosive is used, a failure in the switching operation due to corrosion or the like can be prevented, and the switching operation can be more reliably performed, compared with the case in which the switching means is configured from a mechanical constituent element.

According to the invention, a shock generated when the switching means displaces the spray in the accommodation space is buffered by buffer means, and thus, it is possible to prevent the spray can from being damaged during the switching operation. Thereby, even in the case where the spray can is rapidly displaced using an explosive as described above, it is possible to prevent the spray can from being damaged, and to cause the switching means to reliably switch the spray can to the releasing state.

The invention claimed is:

1. An odor-generating alarm apparatus, comprising:

a casing that defines an accommodation space configured to accommodate a spray can that includes a container body and a nozzle, the container body being filled with an odorous liquid and can be switched between a releasing state in which the odorous liquid is released and a non-releasing state;

a switching device configured to perform a switching operation from the non-releasing state to the releasing state by displacing the container body of the spray can accommodated in the accommodation space of the casing with respect to the casing; and a control device configured to cause the switching device to perform a switching operation from the non-releasing state to the releasing state by displacing the container body of the spray can with respect to the casing, when abnormality information indicating occurrence of an abnormal state is supplied from a detecting device that detects occurrence of an abnormal state.

2. The odor-generating alarm apparatus of claim 1, wherein the switching device further includes an operating portion made of a material that is extended and contracted by application of electricity, and the control device displaces the container body of the spray can by applying electricity to the operating portion.

3. An odor-generating alarm apparatus, comprising:

a casing that defines an accommodation space configured to accommodate a spray can that is filled with an odorous liquid and can be switched between a releasing state in which the odorous liquid is released and a non-releasing state;

a switching device configured to perform a switching operation from the non-releasing state to the releasing state by displacing the spray can accommodated in the accommodation space of the casing with respect to the casing; and a control device configured to cause the switching device to perform a switching operation from the non-releasing state to the releasing state by displacing the spray can with respect to the casing, when abnormality information indicating occurrence of an abnormal state is supplied from a detecting device that detects occurrence of an abnormal state, wherein the switching device generates gas by igniting an explosive, and uses a pressure of the gas to displace the spray can.

4. The odor-generating alarm apparatus of claim 3, further including a buffer device to buffer a shock generated when the switching device displaces the spray can in the accommodation space.

* * * * *